US007757756B2

(12) United States Patent
Bullard

(10) Patent No.: US 7,757,756 B2
(45) Date of Patent: Jul. 20, 2010

(54) BRIDGE PLUG AND SETTING TOOL

(76) Inventor: Gerald Bullard, 1402 Duncan Ave., Alliance, NE (US) 69301

( * ) Notice: Subject to any disclaimer, the term of this patent is extended or adjusted under 35 U.S.C. 154(b) by 0 days.

(21) Appl. No.: 12/403,008

(22) Filed: Mar. 12, 2009

(65) Prior Publication Data

US 2009/0173489 A1 Jul. 9, 2009

Related U.S. Application Data

(63) Continuation-in-part of application No. 11/520,718, filed on Sep. 14, 2006, now Pat. No. 7,559,364.

(51) Int. Cl.
*E21B 33/12* (2006.01)

(52) U.S. Cl. ..... 166/181; 166/192

(58) Field of Classification Search ..... 166/181, 166/192

See application file for complete search history.

(56) References Cited

U.S. PATENT DOCUMENTS

| | | | |
|---|---|---|---|
| 2,238,533 | A | 4/1941 | McClease |
| 2,308,004 | A | 1/1943 | Hart |
| 2,566,323 | A | 9/1951 | Forsyth et al |
| 2,618,340 | A | 11/1952 | Lynd |
| 2,681,114 | A | 6/1954 | Conrad |
| 2,695,065 | A | 11/1954 | Baker et al. |
| 2,843,154 | A | 7/1958 | Hosking |
| 3,082,824 | A | 3/1963 | Taylor |
| 3,105,550 | A | 10/1963 | Ehlert |
| 3,115,164 | A | 12/1963 | Vanderbilt |
| 3,125,162 | A | 3/1964 | Briggs et el. |
| 3,398,803 | A | 8/1968 | Leutwyler et al. |
| 3,457,992 | A | 7/1969 | Brown |
| 3,503,249 | A | 3/1970 | Dumond |
| 3,507,327 | A | 4/1970 | Chenoweth |
| 3,659,648 | A | 5/1972 | Cobbs |
| 3,662,451 | A | 5/1972 | Wagner |
| 3,666,010 | A | 5/1972 | Harris |
| 3,946,761 | A | 3/1976 | Thompson et al. |
| 4,185,702 | A | 1/1980 | Bullard |
| 4,185,705 | A | 1/1980 | Bullard |
| 4,436,150 | A | 3/1984 | Barker |
| 4,482,086 | A | 11/1984 | Wagner et al. |
| 4,493,344 | A | 1/1985 | Mathison et al. |
| 4,760,868 | A | 8/1988 | Saxon |
| 4,898,239 | A | 2/1990 | Rosenthal |
| 5,119,861 | A | 6/1992 | Pino |

(Continued)

*Primary Examiner*—Jennifer H Gay
*Assistant Examiner*—Yong-Suk Ro
(74) *Attorney, Agent, or Firm*—Bacon & Thomas, PLLC

(57) ABSTRACT

A bridge plug comprises an axially compressible cylinder having plural expansion sleeves. A mandrel extends axially through the cylinder, and has a threaded portion engaged with the cylinder, such that rotation of the mandrel causes compression of the cylinder. A setting tool comprises a housing containing a motor and a drive shaft driven by the motor. The setting tool is configured to be removably coupled to a bridge plug with the drive shaft drivingly coupled to the bridge plug's mandrel, such that operation of the setting tool motor causes compression of the bridge plug. The setting tool is used to lower a bridge plug within a well casing, and to compress the bridge plug causing, outward protrusion of sealing members of the bridge plug to set the bridge plug in place. Cement may be applied above the set bridge plug to form an easily drillable seal.

20 Claims, 9 Drawing Sheets

U.S. PATENT DOCUMENTS

| | | | | |
|---|---|---|---|---|
| 5,299,812 | A | 4/1994 | Brestel et al. | |
| 5,794,706 | A | 8/1998 | Alhamad | |
| 5,819,846 | A | 10/1998 | Bolt, Jr. | |
| 6,123,148 | A | 9/2000 | Oneal | |
| 6,491,116 | B2 | 12/2002 | Berscheidt et al. | |
| 0,155,159 | A1 | 8/2003 | Slack at al. | |
| 6,666,275 | B2 | 12/2003 | Neal et al. | |
| 6,782,946 | B2 | 8/2004 | Perkins et al. | |
| 6,796,376 | B2 | 9/2004 | Frazier | |
| 6,866,386 | B1 | 3/2005 | Chen | |
| 6,926,086 | B2 | 8/2005 | Patterson et al. | |
| 6,966,386 | B2 | 11/2005 | Ringgenberg et al. | |
| 7,214,147 | B2 | 5/2007 | Gutierrez | |
| 7,290,617 | B2 | 11/2007 | Popilian et al. | |
| 7,353,879 | B2 | 4/2008 | Todd et al. | |
| 7,559,364 | B2 * | 7/2009 | Bullard | 166/181 |
| 2002/0195253 | A1 | 12/2002 | Hill, Jr. et al. | |
| 2003/0173074 | A1 | 9/2003 | Pietrobelli et al. | |
| 2007/0131410 | A1 * | 6/2007 | Hill et al. | 166/55.8 |
| 2007/0151722 | A1 | 7/2007 | Lehr et al. | |

* cited by examiner

BRIDGE PLUG AND SETTING TOOL

FIELD OF THE INVENTION

The present invention relates to downhole sealing tools and a method of use, and more particularly to a bridge plug and setting tool and a method of using the bridge plug and sealing tool to form a drillable seal within a well bore.

BACKGROUND

In drilling and completion of subterranean wells, such as oil and gas wells, it is often desirable to place or form a seal within the well bore or well bore casing.

For certain drilling or completion tasks, it is further desirable to subsequently remove the seal. Removable sealing tools such as packers and bridge plugs are known for these general purposes. However, retrieving a removable packer or bridge plug is often a complex, expensive, and time consuming process.

It is frequently simpler and less expensive to remove a packer or bridge plug by milling or drilling them from the well bore or casing. However, the milling or drilling operations may be slowed because of the materials of the packer or bridge plug employed. For example, these downhole tools are frequently formed including metallic components, such as hardened iron or steel, which are difficult, or require specialized tools and techniques, to mill or drill.

Additionally, some known packers and bridge plugs are formed from specialized and costly materials to achieve the result of an effective seal that is relatively easy to drill, but with the disadvantage that such packers and bridge plugs remain expensive owing to the cost of the materials employed.

Further, setting methods for known packers and bridge plugs often require a significant force or impulse, such as an explosive charge, to set the packer or bridge plug within a well casing. Because of forces expended during such setting processes, such packers or bridge plugs are rendered unsuitable for use within a PVC casing since the a PVC casing may be ruptured by such a setting force.

Accordingly, a bridge plug and a setting tool for setting a drillable plug in a well bore or casing is desirable. Further, it is desirable for such a bridge plug and setting tool to be useable in PVC as well as other types of casings.

SUMMARY

Downhole sealing tools include a bridge plug and a setting tool for setting a drillable plug or a drillable cement plug in a well bore or casing. A bridge plug comprises an axially compressible cylinder having a top end and a bottom end. The axially compressible cylinder comprises a plurality of expansion sleeves disposed between the top and bottom ends. Adjacent expansion sleeves are joined together by a spacer.

A threaded mandrel extends axially through the cylinder, the mandrel having a drive engaging head disposed above the top end of the cylinder and a threaded end extended through and threadably engaged with the bottom end of the cylinder, such that rotation of the mandrel causes the bottom end of said cylinder to travel along the mandrel.

At least one coupling member is disposed on the top end of the cylinder, the coupling member being configured to be removably engaged with a setting tool.

A setting tool comprises an elongated cylindrical housing having a top end and a bottom end. A motor is disposed within the housing, and has a downwardly extended motor shaft. A drive shaft is coupled to the motor shaft and extends downward from the bottom end of said cylindrical housing. A drive socket is disposed on a bottom end of said drive shaft, the drive socket being configured to engage with the drive engaging head of the bridge plug's mandrel.

At least one coupling member is disposed on the bottom end of the housing, and is configured for removably mounting a bridge plug to the setting tool.

The bridge plug and setting tool are used to set a drillable plug within a well casing by first removably coupling the bridge plug to the setting tool such that the drive engaging head of the bridge plug's mandrel is coupled to the drive shaft of the setting tool, so that operation of the setting tool's motor drives the mandrel to compress the bridge plug. Shear pins are used to secure respective coupling members of the bridge plug and the setting tool together, so that the setting tool may be separated from the bridge plug once the bridge plug is set in place.

The bridge plug and setting tool are lowered into a well casing, by a cable assembly that includes both a supporting cable and a power cable to supply power to the setting tool's motor. Once the bridge plug and the setting tool are located within the well casing at the correct depth, the motor is operated to compress the bridge plug, causing the expansion sleeves to become outwardly expanded and to bear against the inner wall of the casing, setting the bridge plug in place.

With the bridge plug set in place, cement may be applied above the bridge plug to form a drillable cement plug.

These and other features, aspects, and advantages of the present invention will become better understood with regard to the following description, appended claims, and accompanying drawings.

BRIEF DESCRIPTION OF THE DRAWINGS

Similar reference characters denote corresponding features consistently throughout the attached drawings.

DETAILED DESCRIPTION OF VARIOUS EMBODIMENTS

Figure 1:
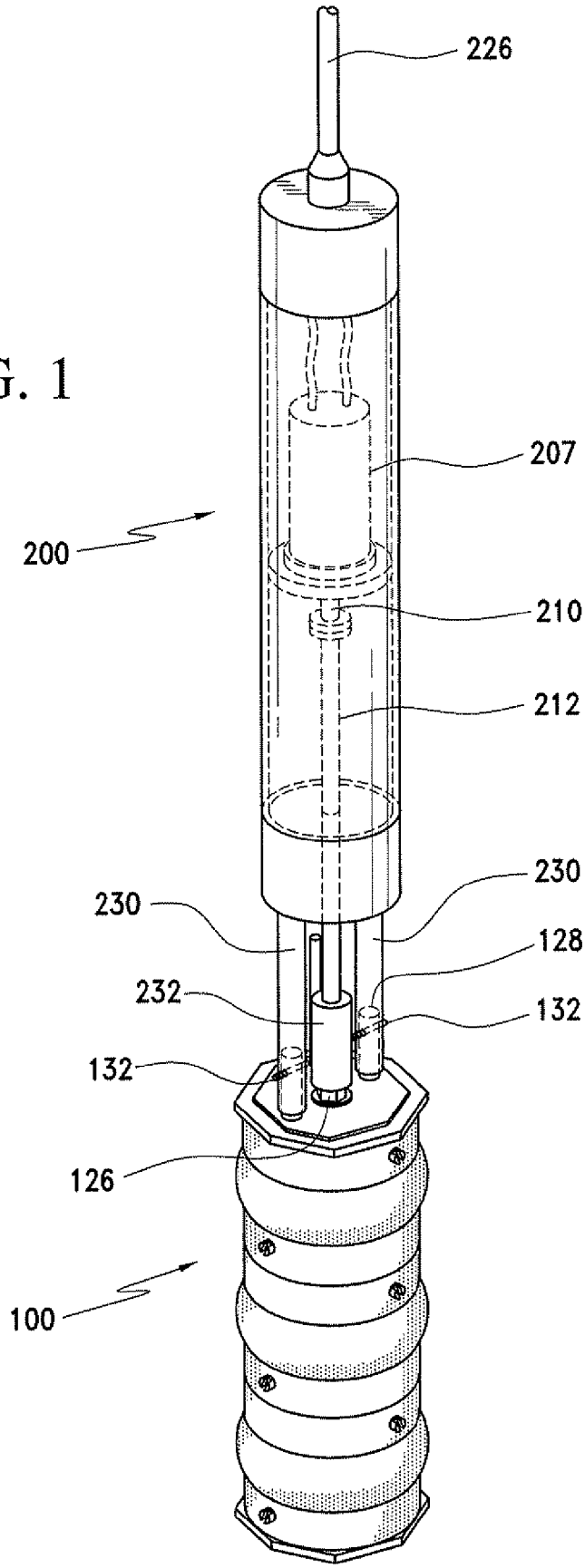
FIG. 1 is a perspective view of a bridge plug according to the present invention coupled to a setting tool.
Figure 2:
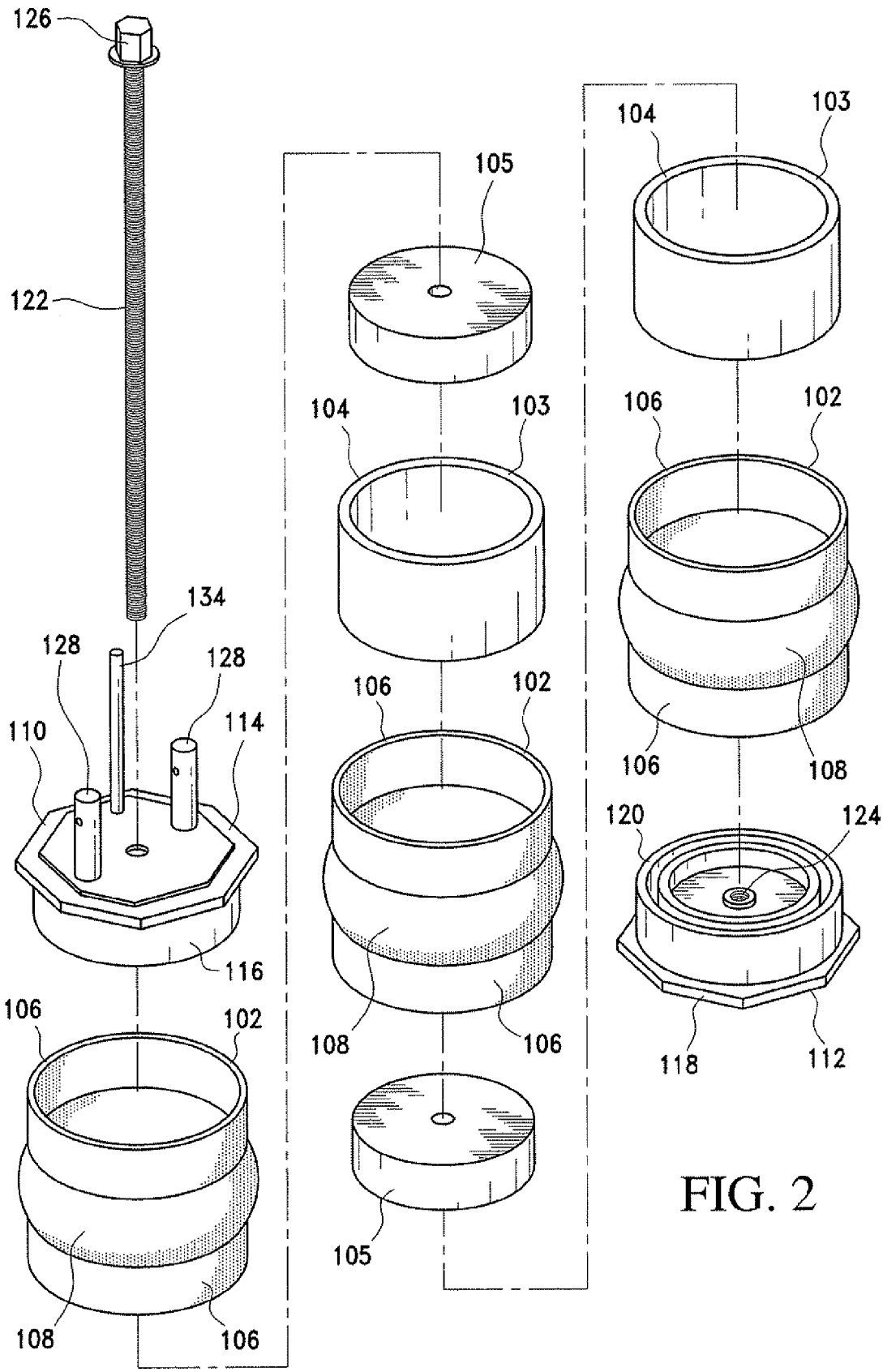
FIG. 2 is an exploded perspective view of the bridge plug shown in FIG. 1.

Referring to FIG. 1, a bridge plug 100 is shown along with a setting tool 200 for the bridge plug 100. The bridge plug 100 is shown in greater detain in FIGS. 2-4.

The bridge plug 100 comprises a plurality of expansion sleeves 102 joined together by expansion sleeve spacers 104 which are disposed between adjacent expansion sleeves 102, forming an axially compressible cylinder. In the illustrated embodiment, the expansion sleeves 102 are generally cylindrical members having upper and lower coupling portions 106 and a central, annularly protruding sealing portion 108.

Figure 3:
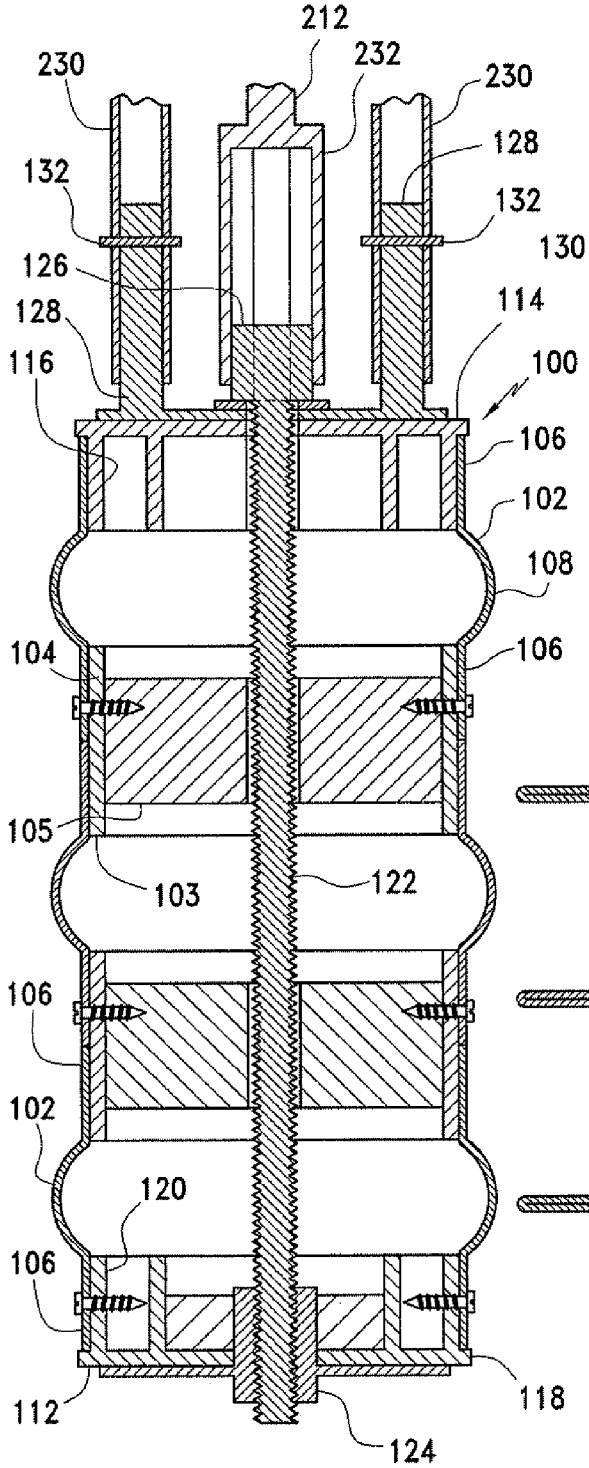
FIG. 3 is a side sectional view of the bridge plug of FIG. 2, in an uncompressed, or unset, state.
Figure 4:
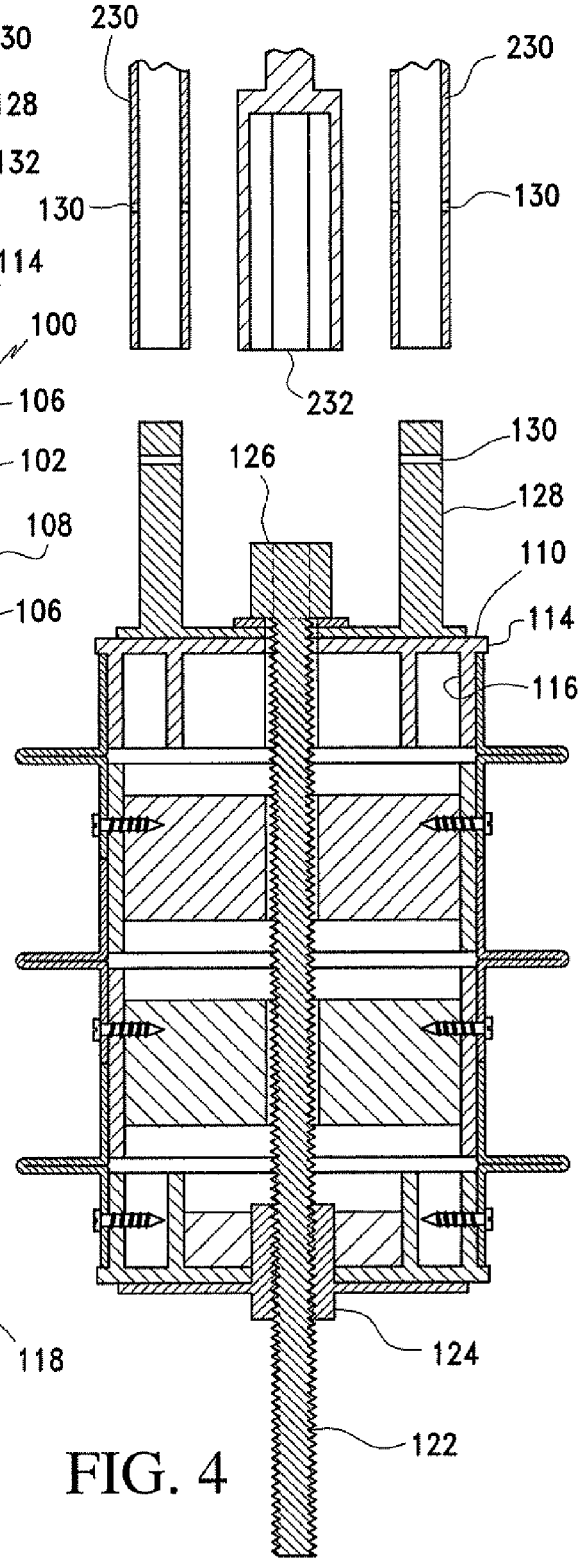
FIG. 4 is a side sectional view of the bridge plug of FIG. 2, in an compressed, or set, state.

Adjacent expansion sleeves 102 are joined together by sleeving the coupling portion 106 of an upper and a lower expansion sleeve 102 respectively over an expansion sleeve spacer 104, as seen in FIGS. 3 and 4.

The expansion sleeve spacers 104 may be of a solid construction, or composed of a cylindrical outer sleeve 103 and a solid inner portion 105 (as shown in the illustrated embodiment), or may be comprised of only the cylindrical outer sleeve 103.

The expansion sleeves 102, and the expansion sleeve spacers 104, are disposed longitudinally between a top end cap 110 and a bottom end cap 112. The top end cap 110 comprises a top end plate 114 and a cylindrical portion 116 which is joined to a top-most expansion sleeve 102 by sleeving the upper coupling portion 106 of the expansion sleeve 102 over the cylindrical portion 116 of the top end cap 110. Similarly, the bottom end cap 112 comprises a bottom end plate 118 and a cylindrical portion 120 which is joined to a bottom-most expansion sleeve 102 by sleeving the bottom coupling portion of the bottom-most expansion sleeve 102 over the cylindrical portion 120 of the bottom end cap 112.

An externally threaded mandrel 122 extends axially through the top and bottom end caps 110, 112. The mandrel 122 is threadably engaged with an internally threaded aperture or hub 124 of the bottom end cap 112 such that rotation of the mandrel 122 causes the bottom end cap 112 to travel along the length of the mandrel 122. A drive engaging head 126, adapted to be engaged or coupled with an external driver or setting tool, is formed on the top end of the mandrel 122 above the top end cap 110.

A rotation of the mandrel 122 causes the bottom end cap 112 to travel along the mandrel 122 toward the top end cap 110, causing compression of the expansion sleeves 102 which in turn causes the annularly protruding sealing portion 108 of each of the expansion sleeves 102 to become further protruded or extended, as seen in FIG. 4.

It is not necessary for the axially compressible cylinder of the bridge plug 100 to be fluid- or water-tight. On the contrary, while it may be desirable for certain applications that the bridge plug 100 be fluid- or water-tight, for other applications is may be desirable that the bridge plug 100 be porous (that is, not creating a fluid- or water-tight seal once set), for example where it is desirable to allow pressure equalization of fluids above and below the set plug. Generally, the bridge plug 100 may be made to be made to be sufficiently porous by simply not providing a sealing means for example in apertures in the end caps through which the mandrel 122 passes. Additionally, apertures may be provided in the end caps or elsewhere to allow for pressure equalization through the plug 100.

The bridge plug 100 is configured to be removably coupled to a setting tool 200 for positioning and setting the bridge plug 100 within a well bore casing. For example, at least one coupling member may be provided on the top end plate 114 of the top end cap 110 and configured to be removably coupled to a fitting on the setting tool 200. In the illustrated embodiment, a pair of coupling posts 128 are provided extending vertically from the top end plate 114 of the top end cap 110. Apertures 130 are provided in the coupling posts 128 so that the coupling posts 128 may be fixed to corresponding mating fittings on the setting tool with shear pins 132, allowing the setting tool 200 to be separated from the bridge plug 100 once the bridge plug 100 is set in the casing.

Much of the bridge plug 100 may be constructed of easily drillable materials. For example, the expansion sleeve spacers 104 and end caps 110, 112 may be constructed from plastic, wood, fiberglass, or materials that are easy to drill in relation to conventional packers and plugs constructed substantially from hardened iron or steel.

Figure 5:
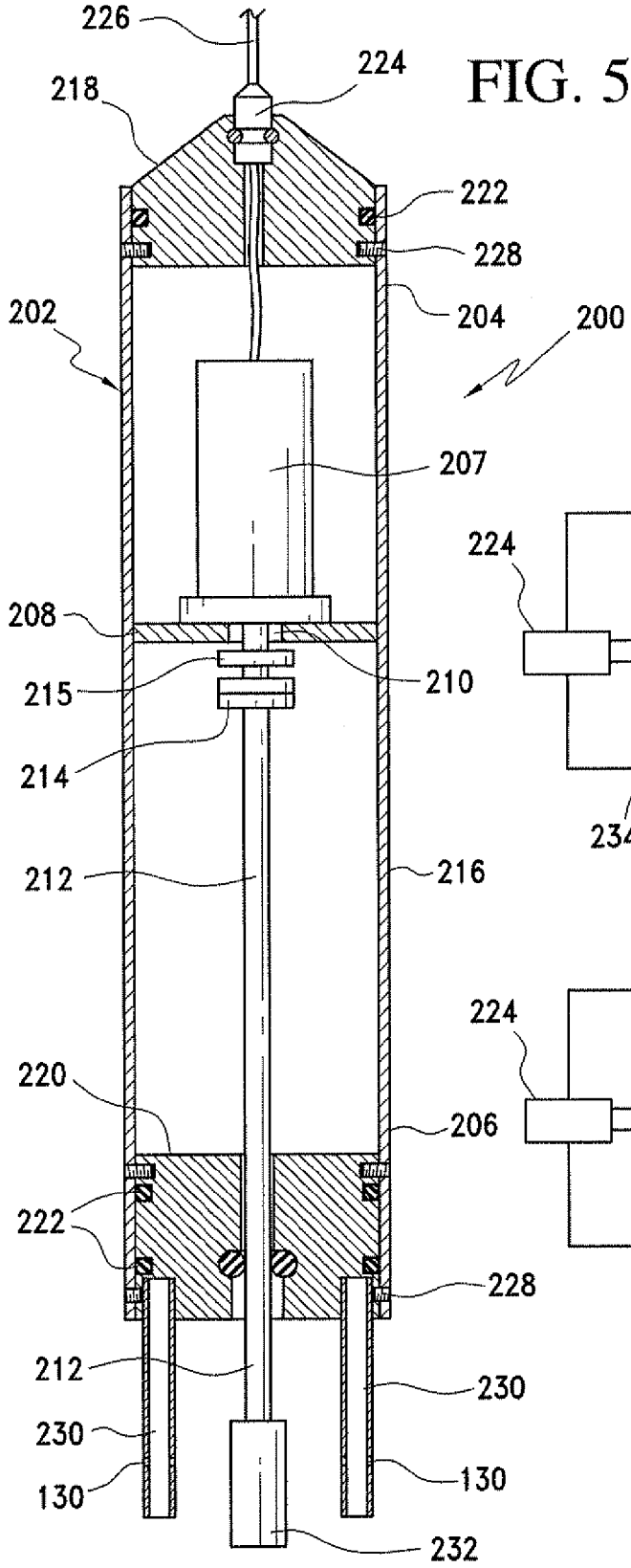
FIG. 5 is a side section view of the setting tool shown in FIG. 1.

Referring to FIGS. 1 and 5, the setting tool 200 comprises an elongate housing 202 configured for insertion within a well bore casing, or the like. A top end 204 of the housing 202 is configured for attachment to a cable or other device for lowering the setting tool 200 into and retrieving the setting tool 200 from the well bore casing. A bottom end 206 of the setting tool 200 is configured for removable attachment to a bridge plug 100.

A motor 207 is supported within the housing 202. In an illustrated embodiment, the motor is supported on a mounting plate 208 disposed within the housing 202. A motor shaft 210 of the motor extends downward from the motor 207 through the mounting plate 208. A drive shaft 212 is attached to the motor shaft 210 by a coupler 214. The drive shaft 212 extends from the bottom 206 of the housing 202.

An illustrated embodiment of the housing 202 includes a cylindrical body portion 216 having a top end plug or cap 218 and a bottom end cap or sealing plug 220 forming an enclosed housing 202.

The top end plug or cap 218 may be disposed on or within the top end of the housing 202. In waterproof embodiments of the setting tool 200, the top end cap 218 may be disposed at least partially within the housing 202, and may be provided with one or more fluid-tight ring gaskets or O-rings 222 disposed about the top end cap 218 to bear against the inner surface of the housing 202.

The top end cap 218 is provided with a connector 224 for coupling the setting tool 200 to a cable assembly 226. The cable assembly 226 includes a support cable for supporting the weight of the setting tool 200 and a bridge plug 100 fastened to the setting tool 200, and at least one electrical cable for providing electrical power to the motor 207. The cable assembly 226 may also include one or more signal lines for controlling the motor 207.

The connector 224 may comprise any such type of detachable plug, screw or interlock mechanism well known in the art and deemed suitable for its intended purpose. The top end cap 218 may also be detachably affixed to the top end 204 of the housing 202 by means of a threaded engagement, lock or set screws 228, or any other similar well known attachment mechanism.

The sealing plug 220 may be provided at the bottom end 206 of the housing 202 to enclose the housing 202 for waterproof embodiments of the setting tool 200, or simply to support the drive shaft 212 as it passes from the bottom end 206 of the housing 202. The drive shaft 212 passes through the sealing plug 220, and a fluid-tight ring gasket or O-ring may be provided about the drive shaft 212 within the sealing plug 220 to prevent well fluids from entering the housing 202. Similarly, one or more fluid-tight ring gaskets or O-rings 222 may be provided about the sealing plug 220 to bear against the inner surface of the housing 202 as an additional precaution.

The setting tool 200 is configured to be removably coupled to a bridge plug 100 for positioning and setting the bridge plug 100 within a casing. For example, at least one coupling member may be provided at the bottom end 206 of the setting tool 200 and configured to be removably coupled to a corresponding fitting on the bridge plug 100.

In the illustrated embodiment, a pair of coupling tubes 230 are provided extending downward from the sealing plug 220. Coupling posts 128 extending upward from the top end plate 114 of the bridge plug 100, and corresponding in position to the coupling tubes 230 of the setting tool 200, are inserted into the coupling tubes 230, and are retained in place by shear pins 132 that pass through aligned apertures 130 in the coupling tubes 230 and coupling posts 128.

A drive socket 232 or another type of coupling member is disposed on the bottom end of the drive shaft 212. The drive socket 232 is configured to be removably engaged with the drive engaging head 126 of the bridge plug 100 so that, while a bridge plug 100 is coupled to the setting tool 200, the mandrel 122 of the bridge plug 100 is driven by rotation of the drive shaft 212.

In some embodiments, a torque-limiting drive element 215, such as an adjustable clutch, may be included between the motor 207 and the coupling member or drive socket 232. By limiting the torque applied to the coupling member (and therefore the torque applied to the mandrel 122 of a bridge plug 100 being set by the setting tool), the degree of compression of the bridge plug 100 may be controlled or limited to control or limit the pressure exerted by the expansion sleeves against the inner wall of a well casing. Accordingly, the bridge plug 100 may be used in well casings that may be ruptured or damaged by excessive pressure. In some embodiments, the torque-limiting drive element 215 may be adjustable, such that the amount of torque applied to the mandrel 122 of a bridge plug 100 may be adjusted.

Figure 6A:
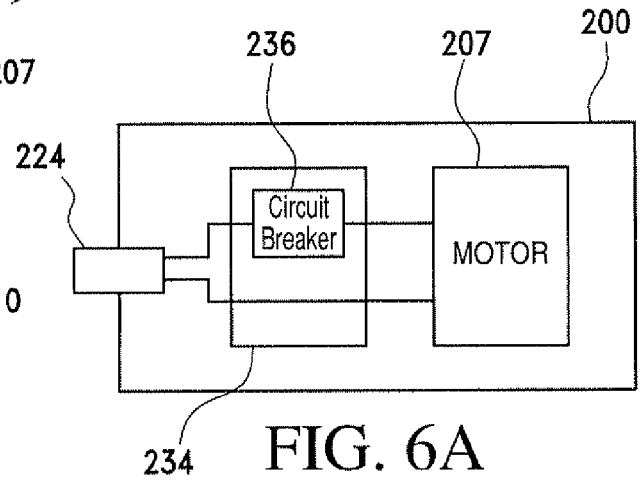
FIG. 6A is a block diagram of a motor and control circuit in a setting tool.
Figure 6B:
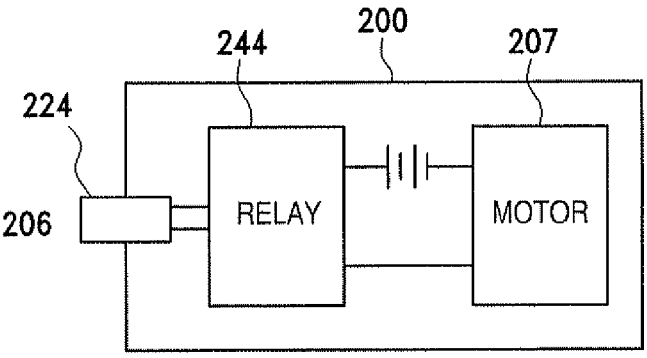
FIG. 6B is a block diagram of a motor and control relay in a setting tool.

Turning to FIG. 6A, a motor control circuit 234 may be provided to automatically shut down the motor 207. For example, a simple motor control circuit 234 may comprise a circuit breaker 236 electrically connected in a power supply circuit to the motor, wherein the circuit breaker 236 has a trip current equal to or less than the stall current of the motor 207. The motor control circuit 234 may be contained within the setting tool 200, or externally located such as within an above ground control station. Alternatively, in embodiments employing a torque-limiting drive element 215, such a motor control circuit 234 is not necessary since the motor may simply be operated for an extended duration, using the torque-limiting drive element 215 to limit the torque applied to the bridge plug 100. In these embodiments, the setting tool 200 may include a power supply 242 and relay 244 as shown in FIG. 6B such that the motor may be switched on and off by a surface operator, switching a control signal to the relay 244 to close and open the relay, powering the motor 207 on and off accordingly.

The bridge plug 100 and setting tool 200 may be used to set a drillable cement plug within a casing (or within an unlined bore hole) as follows.

Figure 7:
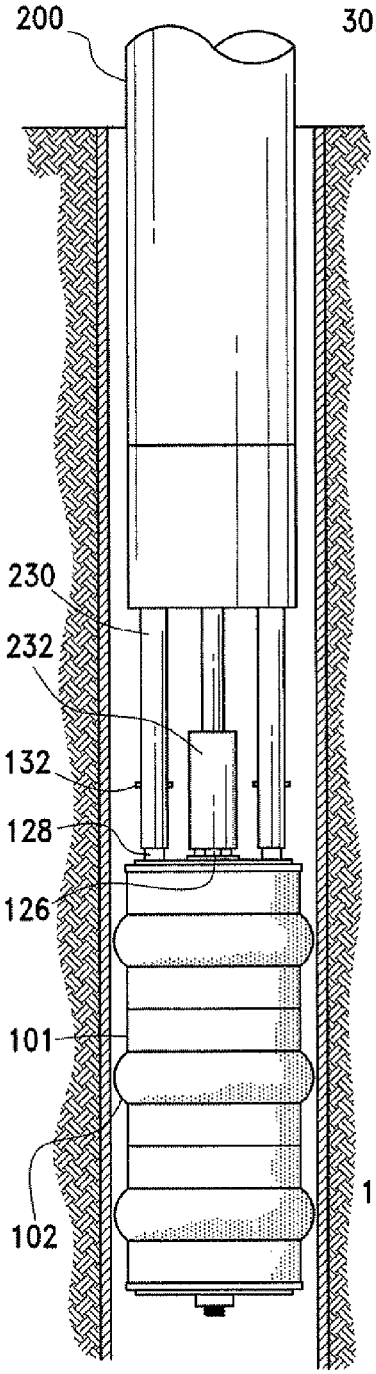
FIG. 7 is a side section view of the setting tool and bridge plug at an initial step during setting of a drillable plug.
Figure 8:
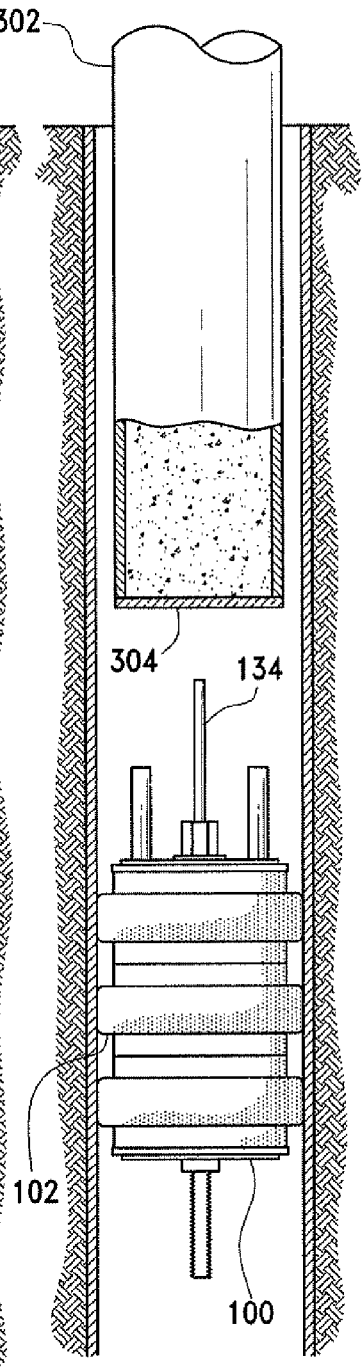
FIG. 8 is a side section view of the setting tool and bridge plug once the bridge plug has been compressed and set in place.
Figure 9:
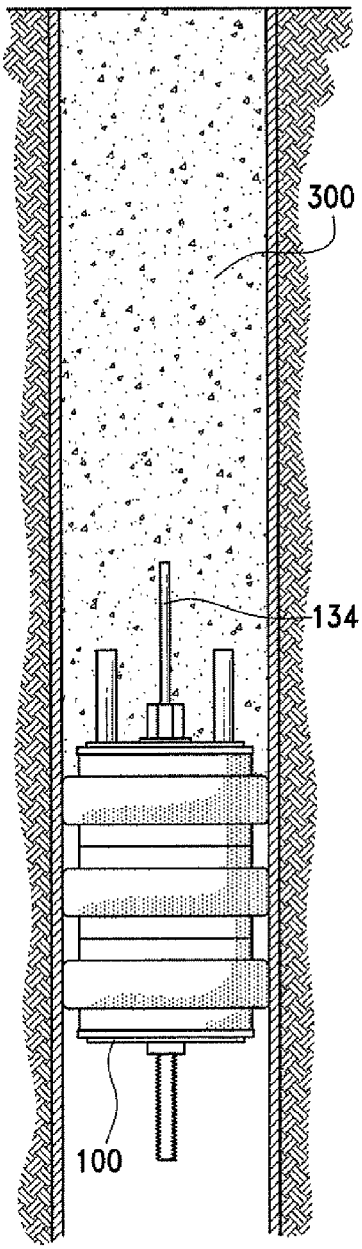
FIG. 9 is a side section view of a completed, cemented plug set according to a method of use of the bridge plug and setting tool.

Referring to embodiments of FIGS. 7-9, a bridge plug 100 is coupled to the setting tool 200 by inserting coupling posts 128 of the bridge plug 100 into coupling tubes 230 of the setting tool 200 such that the drive engaging head 126 of the bridge plug 100 is engaged with the drive socket 232 of the setting tool 200. Shear pins are inserted through the coupling posts 128 and tubes 230, securing the bridge plug 100 to the setting tool 200.

The setting tool 200 and bridge plug 100 are lowered by cable downhole to a depth where the plug is to be set. Electrical control signals are provided to the setting tool 200 by cable, including at least an electrical power supply for driving the motor 207.

When the setting tool 200 and bridge plug 100 are positioned at the correct depth, the motor 207 is operated to turn the mandrel 122, to compress the bridge plug 100, thereby compressing the expansion sleeves 102 such that the sealing portion 108 of each expansion sleeve 102 is protruded outward to bear against the inner wall of the casing.

As the bridge plug 100 is compressed, adjacent expansion sleeve spacers 104 are drawn together, preventing over compression of the bridge plug and the expansion sleeves 102.

Once the bridge plug 100 is fully compressed, the mandrel 122 cannot be further rotated, and so the loading on the motor 207 increases (the motor is stalled). As the motor 207 is stalled, its current draw increases. Thus, an operator at an above ground control station may be provided with an indication that the bridge plug 100 is set by an ammeter measuring current supplied to the motor 207. For example, an operator monitoring the current draw of the motor 207 is alerted to shut down the motor 207 once the current rises to the motor's stall current. Alternatively, the setting tool 200 may shut itself down by operation of motor control circuit 234.

When the bridge plug 100 is fully compressed, and the expansion sleeves fully expanded against the inner wall of the casing, the bridge plug 100 is firmly set within the casing. With the bridge plug 100 set, the setting tool 200 is separated from the bridge plug 100 and removed from downhole. The setting tool 200 is removed by simply drawing the cable upward, causing the shear pins 132 to break so that the setting tool 200 is released from the bridge plug 100.

Once the bridge plug 100 has been set, and the setting tool 200 removed from downhole, a cement plug 300 may be formed above the bridge plug 100.

In one method of forming a cement plug, cement is loaded into a bailer 302 having a glass bottom 304. The bailer 302 is lowered downhole to the bridge plug 100, and the glass bottom 304 is broken to unload the cement. Conventionally, an explosive charge is used to break the glass bottom 304 of the bailer 302. However, referring to FIGS. 8 and 9, an elongated post 134 may be provided on the top end 204 of the bridge plug 100 extending upward to break the glass bottom 304 of the bailer 302. Thus, no explosive charge is needed, since the glass bottom 304 will be broken by the post 134 simply by lowering the bailer 302 onto the post 134.

Figure 10:
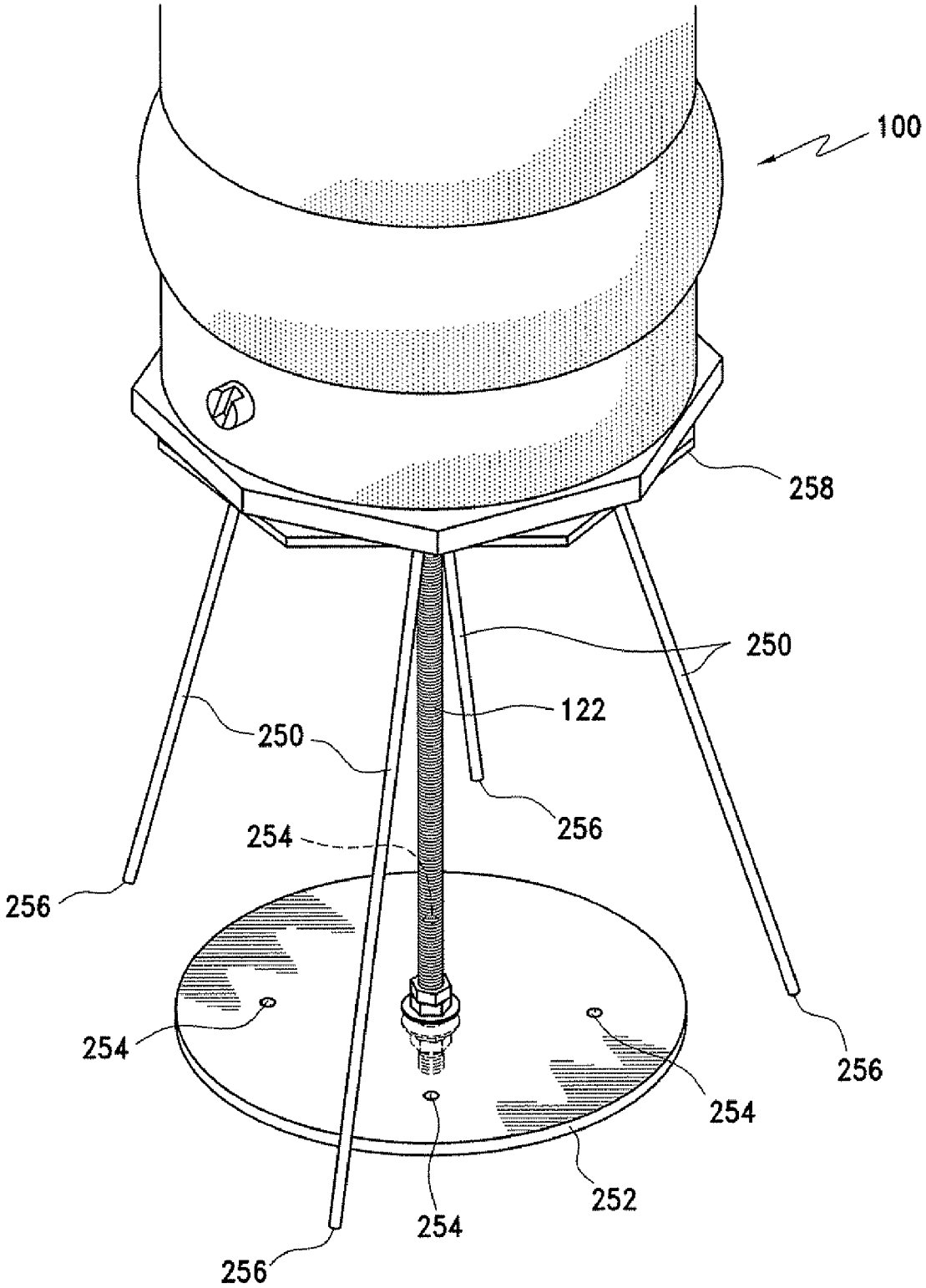
FIG. 10 is a partial perspective view of a bridge plug with slips in a deployed position.
Figure 11:
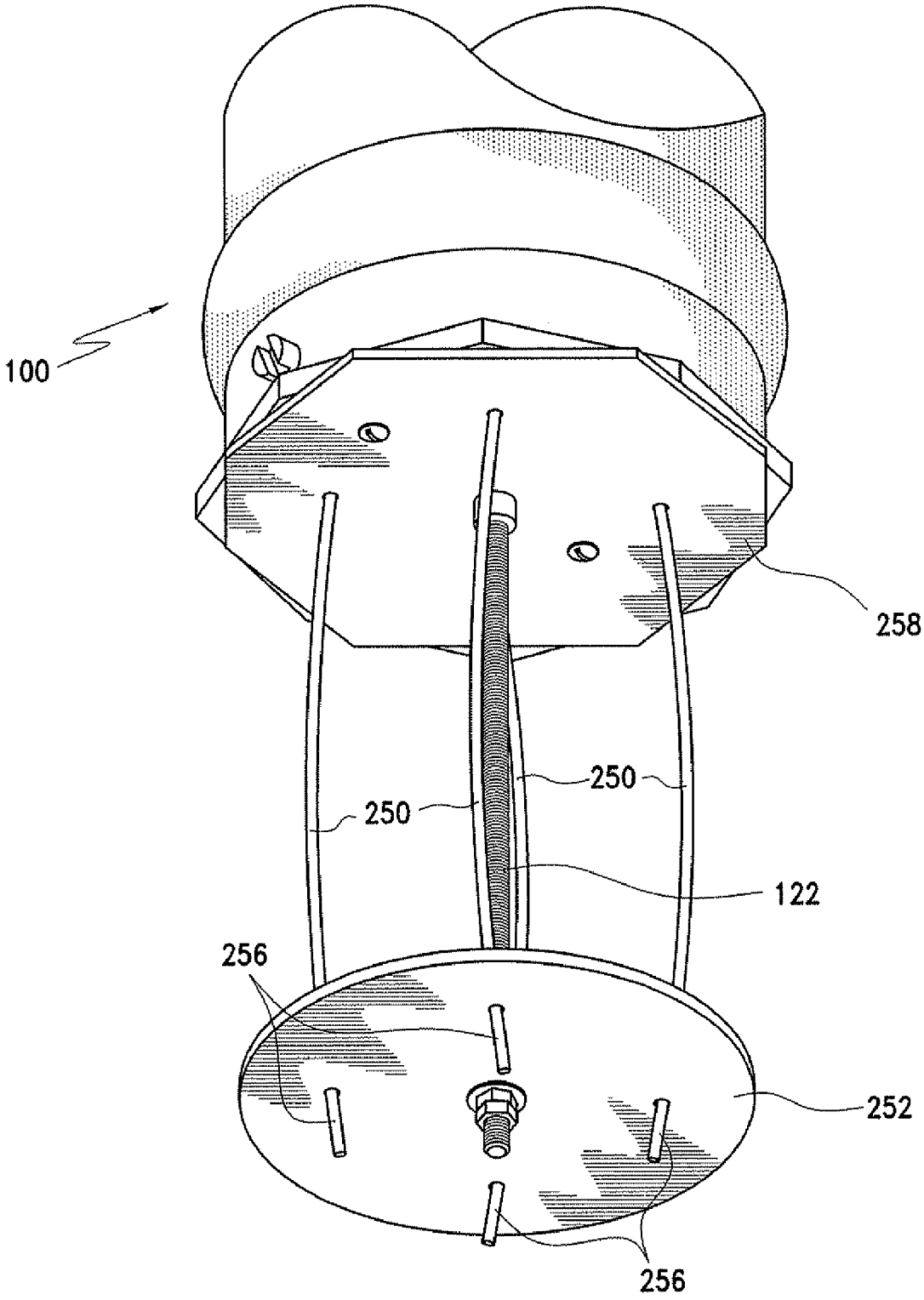
FIG. 11 is a partial perspective view of a bridge plug with slips in a stowed position.
Figure 12:
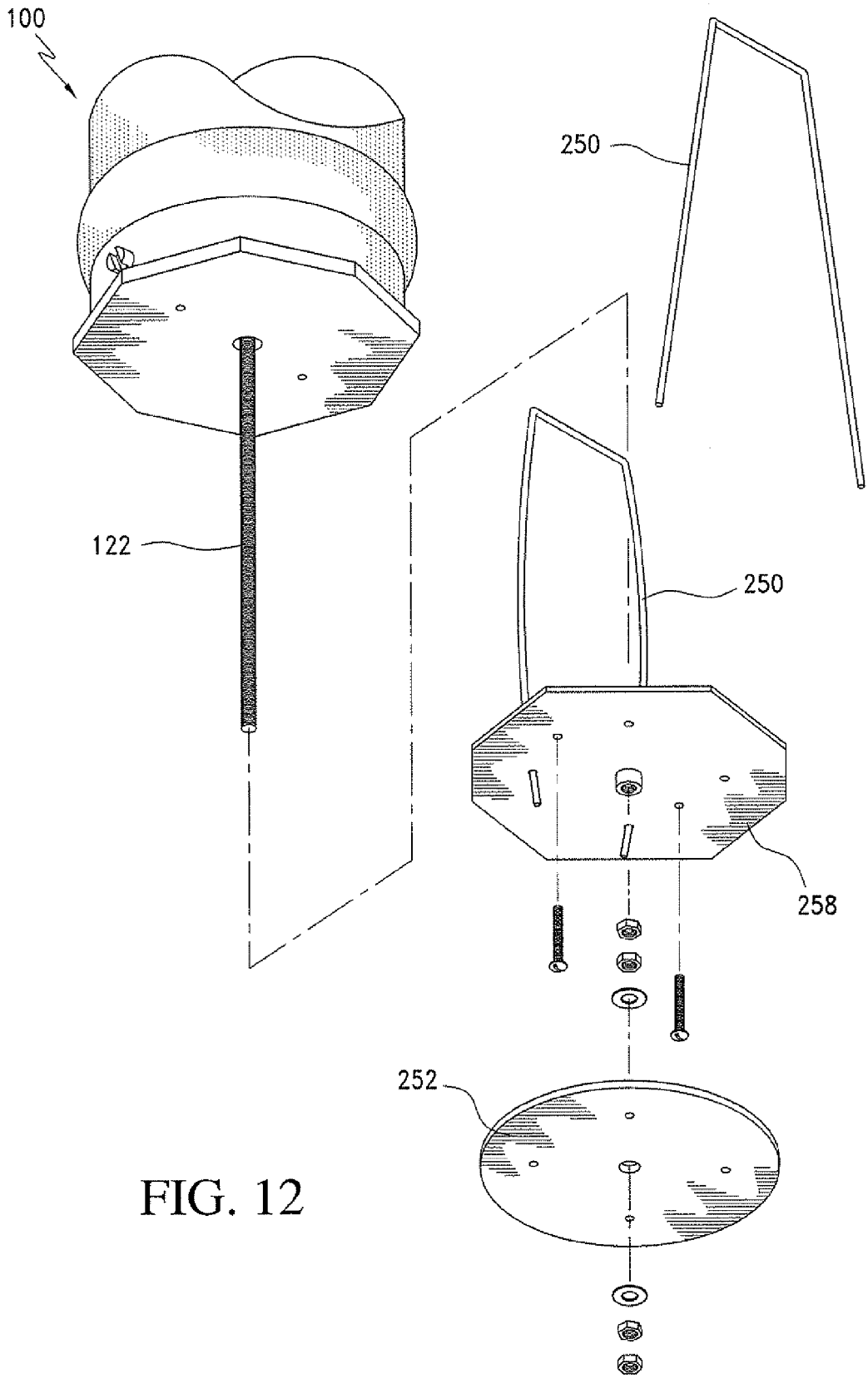
FIG. 12 is an exploded view of an assembly wire slips and a retaining member.

Turning to FIGS. 10-12, slips 250 may be provided on the bridge plug 100 to assist in holding the bridge plug 100 in place within a well bore or casing. In an illustrated embodiment, the slips 250 are provided as a plurality of flexible, resilient wire members extending generally downward and outward from the bottom of the bridge plug 100. The slips 250 are configured to diverge, with their ends extending outwardly beyond an extended circumference of the bridge plug 100, when the slips 250 are deployed. In an undeployed, or stowed, position, the slips 250 are retained within the extended circumference of the bridge plug 100 to allow for placement and positioning of the bridge plug 100.

In this embodiment, the bottom end of the mandrel 122 extends downward from the bottom end of the bridge plug 100, and supports a retaining member 252 which holds the slips 250 in an undeployed or stowed position until the bridge plug 100 is set. During setting of the bridge plug, the slips are drawn from the retaining member 252, such that the slips 250 are released to their deployed position.

For example, a retaining member 252 in the form of a disk or plate is rotatably mounted near the bottom-most end of the mandrel 122. The retaining member 252 is generally fixed in position near the end of the mandrel 122, so that the distance between the retaining member 252 varies as the bottom end of the plug itself travels along the mandrel 122 during the setting process. Plural apertures 254 are formed in the retaining member 252, and bottom ends 256 of the slips 250 are inserted through the apertures 254 to hold the slips 250 in their stowed position during positioning and setting of the bridge plug 100.

In one arrangement shown in FIG. 12, four wire slips 250 are formed from two lengths of a wire such as spring wire, piano wire, or the like, formed into a U shape (to define the four slips 250 from the two wire lengths). The two U-shaped wires are fixed to the bottom end of the plug by an end plate 258, such that the wire ends pass through apertures in the end plate 258 to extend downward from the bottom end of the plug.

Figure 13:
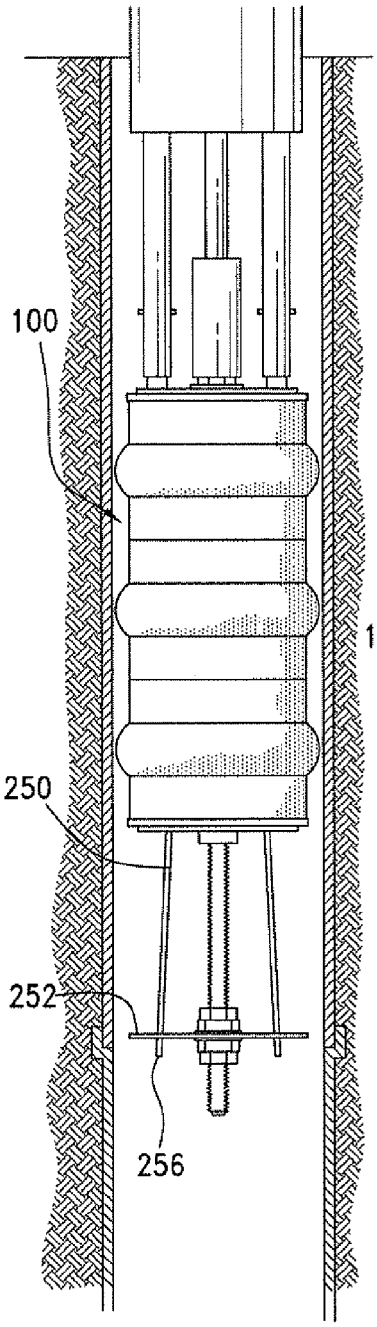
FIG. 13 is a side section view of a bridge plug positioned within a well casing with slips stowed.
Figure 14:
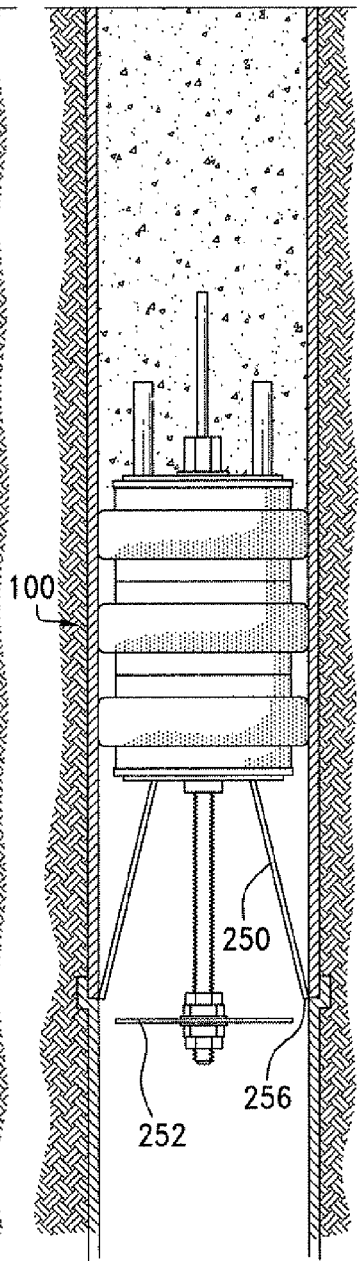
FIG. 14 is a side section view of a bridge plug positioned within a well casing with slips deployed.
Figure 15:
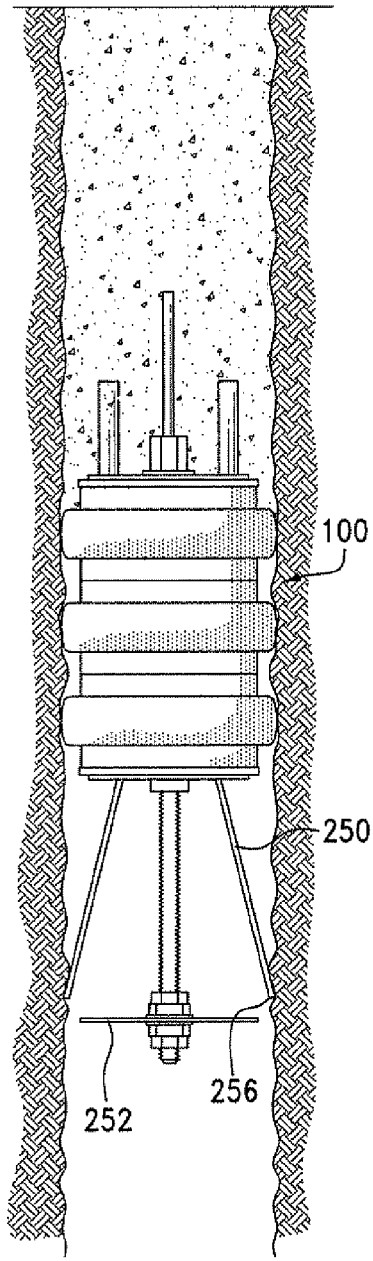
FIG. 15 is a side section view of a bridge plug positioned within an unlined well bore with slips deployed.

Referring to FIGS. 13-15, a bridge plug 100 is shown first with the slips stowed (FIG. 13) during placement of the plug 100. As the plug 100 is set, the slips 250 are deployed (as the upward movement of the bottom end of the plug 100 draws the slips free from the retaining member 252), such that the slips 250 can catch on a joint in a well casing (FIG. 14), or embed in the wall of an unlined or uncased well bore (FIG. 15), for example, to more securely hold the plug 100 in place, such as preventing the plug from slipping downward under the weight of cement placed above the plug 100.

It will be understood that the above-described embodiments of the invention are illustrative in nature, and that modifications thereof may occur to those skilled in the art. Accordingly, this invention is not to be regarded as limited to the embodiments disclosed herein, but is to be limited only as defined in the appended claims.

I claim:

1. A bridge plug, comprising:

an axially compressible cylinder having a top end and a bottom end;

a plurality of slips extending downwardly from the bottom end of said cylinder, the slips being resiliently biased toward a deployed position wherein ends of the slips extend outwardly beyond an extended outer circumference of said cylinder;

a threaded mandrel extending axially through said cylinder, the mandrel having a drive engaging head disposed above the top end of the cylinder and a threaded end extended through and threadably engaged with the bottom end of said cylinder, whereby rotation of the mandrel causes the bottom end of said cylinder to travel along the mandrel;

a retaining member disposed near a bottom end of said mandrel, the retaining member being configured to releasably retain said slips in an undeployed position wherein the ends of the slips are held within the extended outer circumference of said cylinder; and at least one coupling member disposed on the top end of said cylinder, the coupling member being configured to be removably engaged with a setting tool;

wherein said retaining member is movable relative to the bottom end of said cylinder between a retaining position wherein the ends of the slips are retained in said undeployed position and a deploying position wherein the ends of the slips are released such that the slips move to their deployed position.

2. The bridge plug according to claim 1, wherein said axially compressible cylinder comprises a plurality of expansion sleeves disposed between said top end and said bottom end.

3. The bridge plug according to claim 2, wherein said expansion sleeves are generally cylindrical in form, and have upper and lower coupling portions and a central, annularly protruding sealing portion.

4. The bridge plug according to claim 2, wherein said expansion sleeves are rubber.

5. The bridge plug according to claim 2, wherein said at least one coupling member comprises a pair of coupling members.

6. The bridge plug according to claim 5, wherein said coupling members are coupling posts or coupling tubes.

7. The bridge plug according to claim 5, wherein said coupling members are arranged to correspond to mating coupling members of said setting tool.

8. The bridge plug according to claim 1, wherein said plurality of slips comprises a plurality of wires fixed to the bottom end of said cylinder and having free ends extending downward and outward from said bottom end.

9. The bridge plug according to claim 8, wherein said spacer is a solid disk.

10. A bridge plug setting tool, comprising:

an elongated cylindrical housing having a top end and a bottom end;

a motor disposed within said cylindrical housing, the motor having a downwardly extended motor shaft;

a drive shaft coupled to said motor shaft and extending downward from the bottom end of said cylindrical housing;

a torque-limiting drive element disposed between said motor and said bottom end of said drive shaft;

a drive socket disposed on a bottom end of said drive shaft;

at least one coupling member disposed on the bottom end of said housing, the coupling member being configured for removably mounting a bridge plug.

11. The setting tool according to claim 10, further comprising a connector disposed at the top end of said housing, the connector being configured for connection of a cable assembly.

12. The setting tool according to claim 11, wherein said connector includes at least one electrical connection electrically connected to said motor.

13. The setting tool according to claim 10, further comprising a control circuit electrically connected to said motor.

14. The setting tool according to claim 13, wherein said control circuit comprises a circuit breaker.

15. The setting tool according to claim 14, wherein said circuit breaker has a trip current equal to or less than a stall current of said motor.

16. The bridge plug according to claim 10, wherein said at least one coupling member comprises a pair of coupling members.

17. The bridge plug according to claim 16, wherein said coupling members are coupling posts or coupling tubes.

18. The bridge plug according to claim 17, wherein said coupling members are arranged to correspond to mating coupling members of said setting tool.

19. The setting tool according to claim 18, wherein said coupling members are configured to accommodate a shear pin mutually engaged with said mating coupling members of said bridge plug.

20. A well plug setting apparatus, comprising:

a plug setting tool comprising an elongated cylindrical housing having a top end and a bottom end; a motor disposed within said cylindrical housing, the motor having a downwardly extended motor shaft; a drive shaft coupled to said motor shaft and extending downward from the bottom end of said cylindrical housing; a torque-limiting drive element disposed between said motor and said bottom end of said drive shaft; a drive socket disposed on a bottom end of said drive shaft; at least one tool coupling member disposed on the bottom end of said housing;

a plug coupled to said plug setting tool, the plug comprising an axially compressible cylinder having a top end and a bottom end; a threaded mandrel extending axially through said cylinder, the mandrel having a drive engaging head disposed above the top end of the cylinder and a threaded end extended through and threadably engaged with the bottom end of said cylinder, whereby rotation of the mandrel causes the bottom end of said cylinder to travel along the mandrel; at least one plug coupling member disposed on the top end of said cylinder and corresponding to the at least one tool coupling member, said at least one plug coupling member being removably coupled to said at least one tool coupling member;

wherein said drive socket is drivingly engaged with said drive engaging head, whereby rotation of said drive shaft rotates said mandrel to compress said axially compressible cylinder.

* * * * *